US006754984B2

(12) United States Patent
Schaudt et al.

(10) Patent No.: US 6,754,984 B2
(45) Date of Patent: Jun. 29, 2004

(54) SPORTS SHOE

(75) Inventors: Thomas Schaudt, Haigerloch (DE); Thomas Keppler, Gomaringen (DE)

(73) Assignee: Uhlsport GmbH, Munich (DE)

( * ) Notice: Subject to any disclaimer, the term of this patent is extended or adjusted under 35 U.S.C. 154(b) by 0 days.

(21) Appl. No.: 10/152,559

(22) Filed: May 21, 2002

(65) Prior Publication Data

US 2002/0178619 A1 Dec. 5, 2002

(30) Foreign Application Priority Data

May 31, 2001 (DE) ..... 101 26 557

(51) Int. Cl.[7] ..... A43B 5/00
(52) U.S. Cl. ..... 36/128; 36/134; 36/67 D
(58) Field of Search ..... 36/126, 127, 128, 36/129, 134, 131, 132, 25 R, 67 D

(56) References Cited

U.S. PATENT DOCUMENTS

| | | | | | |
|---|---|---|---|---|---|
| 1,141,889 | A | * | 6/1915 | Trolle | 36/36 R |
| 2,268,057 | A | * | 12/1941 | Newman | 36/126 |
| 3,484,957 | A | * | 12/1969 | Druilhet | |
| 4,107,858 | A | | 8/1978 | Bowerman et al. | |
| 4,546,559 | A | * | 10/1985 | Dassler | 36/129 |
| 4,742,626 | A | * | 5/1988 | Tadiotto | 36/127 |
| 4,858,343 | A | * | 8/1989 | Flemming | 36/128 |
| 4,866,861 | A | * | 9/1989 | Noone | 36/127 |
| 4,914,838 | A | | 4/1990 | Ihlenburg | |
| 5,243,775 | A | * | 9/1993 | Swain | 36/134 |
| 5,524,367 | A | * | 6/1996 | Ferreira et al. | 36/134 |
| 5,628,129 | A | * | 5/1997 | Kilgore et al. | 36/134 |
| 5,979,083 | A | * | 11/1999 | Robinson et al. | 36/127 |

FOREIGN PATENT DOCUMENTS

| | | |
|---|---|---|
| DE | 1 685 709 | 7/1971 |
| DE | 3 134 81 7 A1 | 3/1983 |
| DE | 3 706 071 A1 | 2/1987 |
| DE | 692 03 554 T2 | 3/1993 |
| JP | 05091904 A | 4/1993 |

* cited by examiner

*Primary Examiner*—Marie D. Patterson
(74) *Attorney, Agent, or Firm*—Frost Brown Todd LLC

(57) ABSTRACT

A sports shoe, in particular a soccer boot, comprises a sole (1) which is made of plastic and has on its underside (2) at least one carrier surface (3 to 5) which is configured raised. In each of these surfaces there are embedded at least two threaded inserts (6) that serve for receiving traction elements (7 to 10) capable of being screwed in. The shoe is characterized in that the at least one carrier surface (3 to 5) has such a geometric shape and the threaded inserts (6) in the at least one carrier surface (3 to 5) are positioned such that several interchangeable sets of different traction elements (7 to 10) are able to be screwed into the threaded inserts (6).

8 Claims, 3 Drawing Sheets

SPORTS SHOE

The invention relates to a sports shoe, in particular a soccer boot, comprising a sole which is made of plastic and has on its underside at least one carrier surface which is configured raised, in each of which surfaces at least two threaded inserts being embedded that serve for receiving traction elements capable of being screwed in.

Such sports or casual shoes, which comprise screw-in studs or spikes as traction elements capable of being screwed in, have been known for a long time. In case of damage, these studs or spikes can be replaced in a relatively easy manner, but only by studs and spikes of the same type and size, which are available as a spare part set matching with the type of sports shoe concerned.

From DE-A-44 17 563 there is known a soccer boot comprising a sole which is equipped not only with exchangeable screw-in studs or cams, but additionally with a second type of traction elements, namely elongate, wedge-shaped gripping elements which are arranged primarily along the edge of the sole and enhance the jump- and acceleration power of a soccer player by ensuring an improved security against slipping and an improved anchoring of the shoe in the ground.

From EP-A-0 533 570 there is known a sports shoe sole for sports shoes, on the underside of which several reinforcement plates are provided in which traction elements, preferably spikes and studs, are integrated. The traction elements may be integrally connected with the reinforcement plates; however, they may also be connected with the reinforcement plates so as to be exchangeable and, hence, detachable. With the assistance of the reinforcement plates, the application of pressure on the sole caused by the individual spikes or studs is to be distributed across a larger surface area in order to avoid painful straining points on the athlete's feet.

Inherent in the sports shoes or soles known from the aforementioned prior art is the disadvantage that they can only be equipped with one type of traction elements each, either only with screw-in studs, or only with cams or only with spikes. Having such shoes, it is very difficult for e.g. a professional soccer player to safely play both on soft grass fields and on hard sand fields. This means that the player needs a special pair of shoes for each subsoil condition, the traction elements of which are specifically adapted to the respective condition of the field, so that in each case there are needed shoes which are equipped in a different manner for a dry and humid lawn as well as for dry and humid hard fields.

In order to remedy this disadvantage, the invention is based on the object to provide sports shoes with a sole that can be interchangeably equipped with different sets of traction elements of the most different type, so that depending on the condition of the field one and the same shoe can be equipped either with studs, cams or spikes, or also with clamping jaws that have a large surface area and extend transversely across the entire width of the sole.

This object is solved according to the invention in a sports shoe of the type initially mentioned in that the at least one carrier surface has such a geometric shape and the threaded inserts in the at least one carrier surface are positioned such that several interchangeable sets of different traction elements are able to be screwed into the threaded inserts.

Thereby it is achieved that a sportsman, in particular a professional soccer player, not only finds shoes for a specific ground condition which are ideal for him, whilst with a changed condition of the field he has to look for trade-offs between comfort of the shoe and functionality of the sole, but due to the invention is able to adapt his personally optimal shoe to varying conditions of the field and ground compositions in that he exchanges the available set of traction elements completely by another set of traction elements of a different kind. This interchangement feature significantly reduces, on the one hand, the costs for the respective athlete or player; above all, there is no longer a need for the player to get involved in trade-offs with varying conditions of the field, but he can play with his personally optimal pair of shoes both on grass fields and hard fields, on dry and on wet fields with optimum safety.

Preferably, the at least one carrier surface which is configured raised is formed in one piece with the sole made of plastic, because this reduces the production costs, but above all immovably fixes the carrier surfaces. The at least one carrier surface preferably extends across the entire width of the sole, so that all conceivable geometries of traction elements can be interchangeably and, hence, detachably fastened to the carrier surface.

In a preferred embodiment of the invention, the traction elements of a first set of such elements fully cover the at least one carrier surface, whilst the traction elements of a second set only partially cover the carrier surface(s). With such different sets of traction elements, the sports shoe offers a reliable grip on almost all grounds and field conditions.

Preferably, there is provided close to the distal and proximal longitudinal edges of the sole in each carrier surface at least one threaded insert each, i.e. at least two threaded inserts per carrier surface. The carrier surfaces may also be equipped with more than two threaded inserts, but not each of these additional threaded inserts having to be equipped with a traction element with each ground condition. Threaded inserts that are not used are preferably covered by a plastic cap or a screw closure, in order to protect the internal thread of the insert against soiling.

In one embodiment of the sports shoe according to the invention, the traction elements consist of a set of screw-in studs, cams or spikes, of which each screw-in stud, cam or spike comprises a threaded bolt capable of being screwed into the threaded inserts. The screw-in studs preferably comprise a collar in the shape of a truncated cone, the larger base circular area of which is adapted to the extent of the at least one carrier surface, so that the base circular area has an all-over, snug fit at the carrier surface without any gap, if the screw-in stud is screwed completely into the threaded insert.

In a further embodiment of the sports shoe according to the invention, the traction elements consist of a set of clamping jaws which extend across the entire width of the sole and comprise a mounting surface adapted to the geometric shape of the at least one carrier surface as well as through-holes for receiving fastening screws, the through-holes being registered with the threaded inserts. "Being registered" means that the through-holes not only are aligned with the threaded inserts, but also that there are aligned threaded inserts at those places where through-holes are arranged, and vice versa.

The clamping jaws preferably taper with increasing distance from the surface of the sole, to be precise, starting from their mounting surface. Thus, directly adjacent to the respectively associated carrier surface the wall thickness of the clamping jaws is the largest, and decreases with an increasing distance from the sole's surface. In the region of their maximum distance from the sole's surface, the clamping jaws preferably form narrow webs which would contact the ground exclusively, if shoe or sole could not sink in the ground. These webs, which are situated at a maximum distance from the sole's surface, are preferably only formed at the edges of the sole, i.e. only at places close to the lateral and medial longitudinal edges of the sole, and not in the sole center, in the region of the center of the shoe tip and in the region of the center of the heel.

In a further preferred embodiment of the sports shoe according to the invention, the at least one carrier surface and the mounting surfaces of the clamping jaws are configured so as to be H-, U-, V- or horseshoe-shaped, with the legs or "extremities" of these geometric shapes being adapted to the natural curvatures of the distal and proximal longitudinal edges and the rounded portions in the region of the shoe tip and the heel.

The traction elements are preferably made of metal, plastic, fiber-reinforced or whisker-reinforced plastic, ceramics or composite materials of one or more of these materials. The traction elements are preferably made of a composite material including an elastomer component, because then an optimal trade-off can be achieved between fracture toughness, strength and elasticity.

Particularly preferred materials for the traction elements are cast aluminum and/or a titanium-aluminum precision casting alloy.

If the at least one carrier surface, which is configured raised, and the traction elements are dyed, and if the sole, the carrier surface(s) and the traction elements are dyed preferably with different colors, then it is readily possible to associate different sets of different traction elements to specific application purposes, which makes it easier for the wearer of the sports shoe to choose the different sets of traction elements for different grounds.

In the following, the invention will be explained in more detail by means of the drawing.

Figure 1:
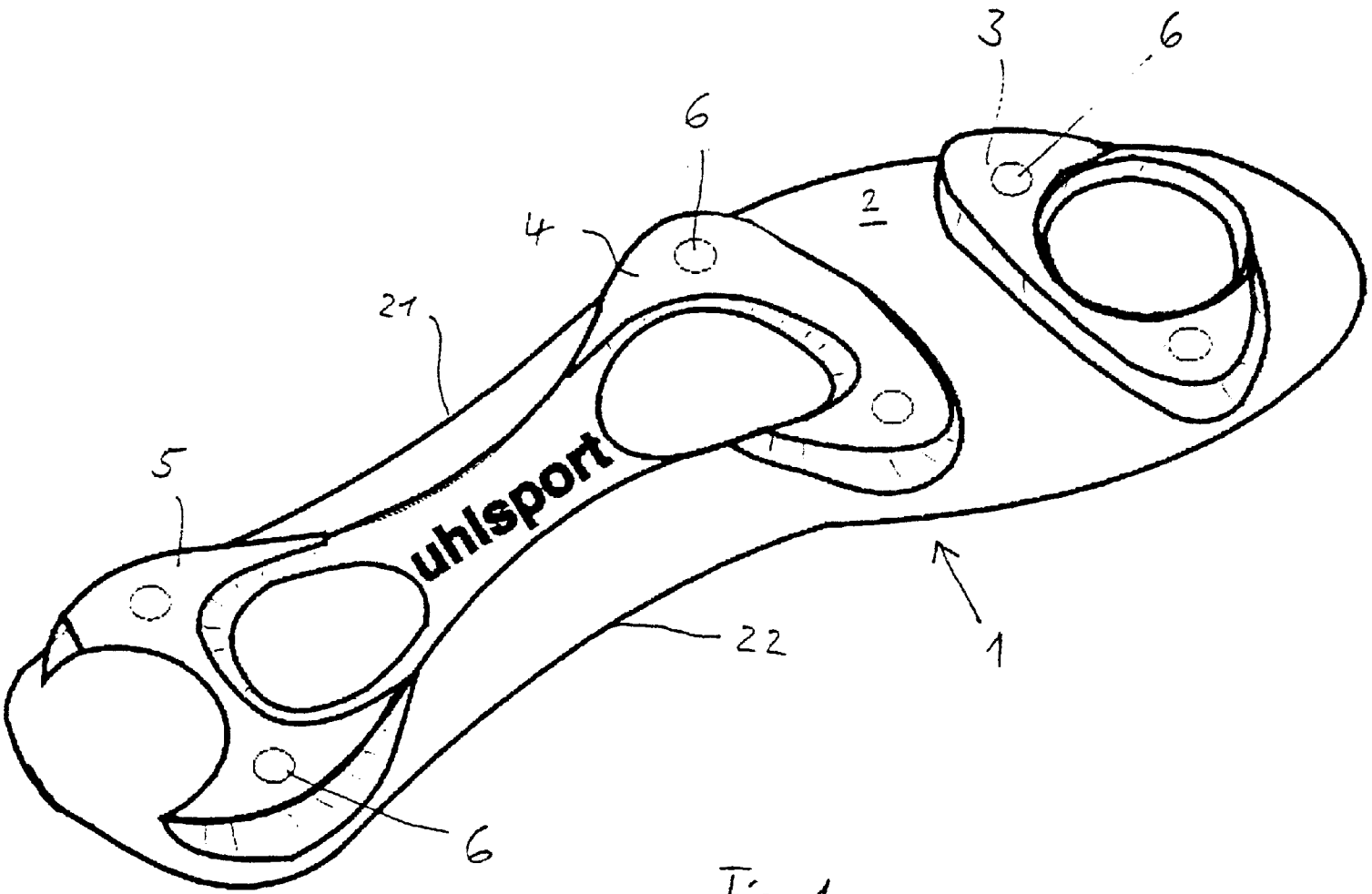
FIG. 1 is a perspective view of the underside of the sole of an embodiment of the sports shoe according to the invention.

The sole 1 (FIG. 1) of an embodiment of a soccer boot according to the invention is integrally cast or injection-molded from an impact-resistant plastic such as polyamide. Formed into the underside 2 of the sole 1 are integrally configured, raised carrier surfaces 3, 4, 5, the carrier surface 3 in the region of the shoe tip and the carrier surface 4 in the region of the ball being configured approximately U-shaped, whilst the carrier surface 5 in the region of the heel being configured approximately H-shaped.

The raised carrier surfaces 3, 4, 5 extend transversely across the entire width of the sole 1, their outer contours being adapted to the curved extent of the distal longitudinal edge 21 and the proximal longitudinal edge 22 of the sole 1.

Embedded in the carrier surfaces 3, 4, 5, which are configured raised, are two threaded inserts 6 each, which serve for the fastening of traction elements that are to be screwed into these threaded inserts.

Figure 2:
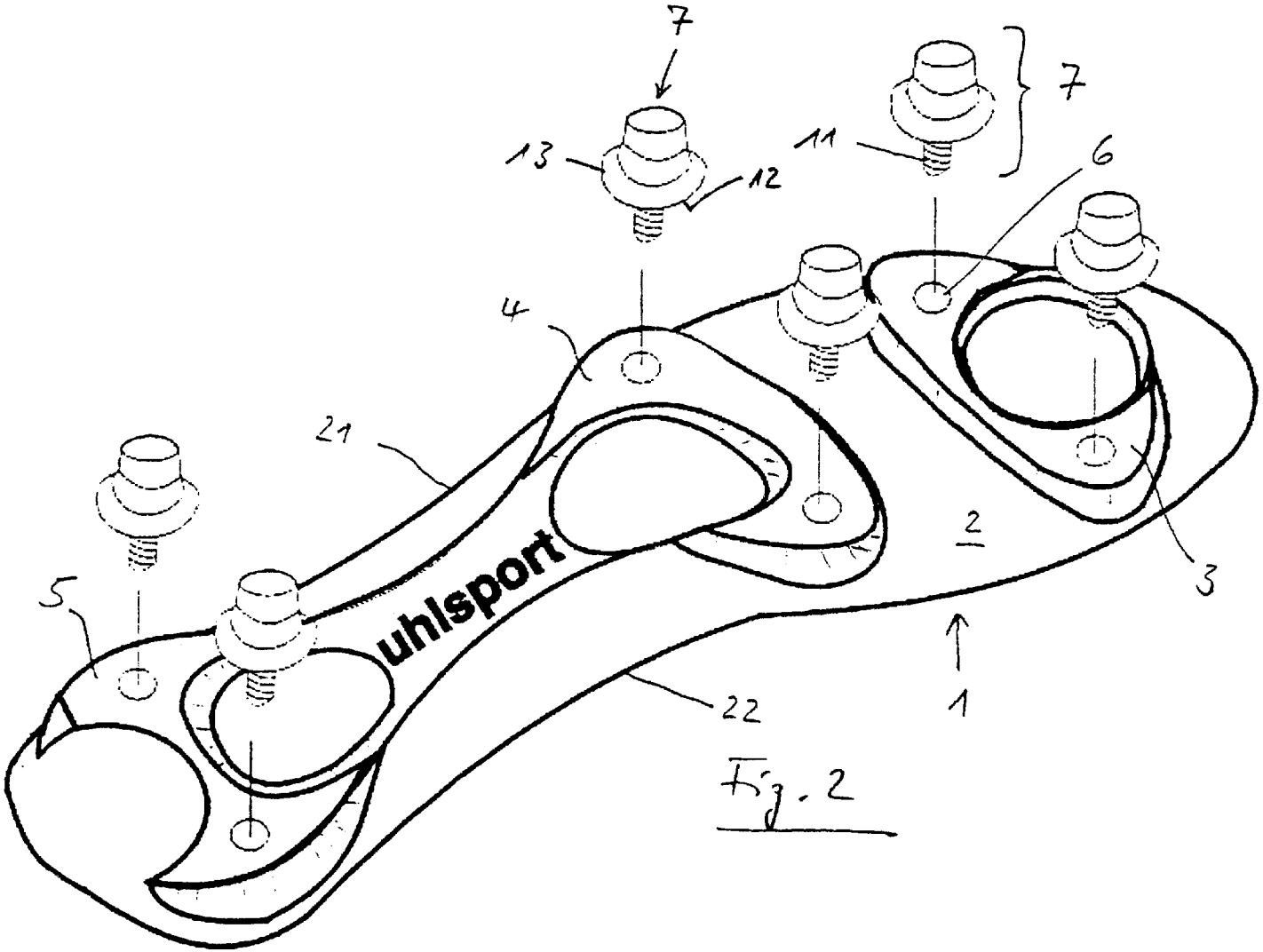
FIG. 2 is a perspective view of the underside of the sole of FIG. 1, equipped with six individual screw-in studs.

In the embodiment illustrated in FIG. 2, the sole 1 is equipped with six screw-in studs 7, the threaded bolts 11 of which are able to be screwed into the threaded inserts 6. The threaded bolts 7 are each provided with a collar 13 in the shape of a truncated cone, the larger base circular area 12 of which is adapted to the extent of the carrier surfaces 3, 4, 5 in such a manner that, on the one hand, the collar 13 does not extend beyond the outer edges of the raised carrier surfaces 3, 4, 5 and, on the other, that the base circular area 12 has an all-over, snug fit at the carrier surfaces 3, 4, 5 without any gap, if the screw-in studs 7 are screwed completely into the threaded inserts 6.

In the embodiment illustrated, at least the metal core of the screw-in studs 7 with the threaded bolt 11 included, consists mainly of cast aluminum and/or a titanium-aluminum precision cast alloy.

Figure 3:
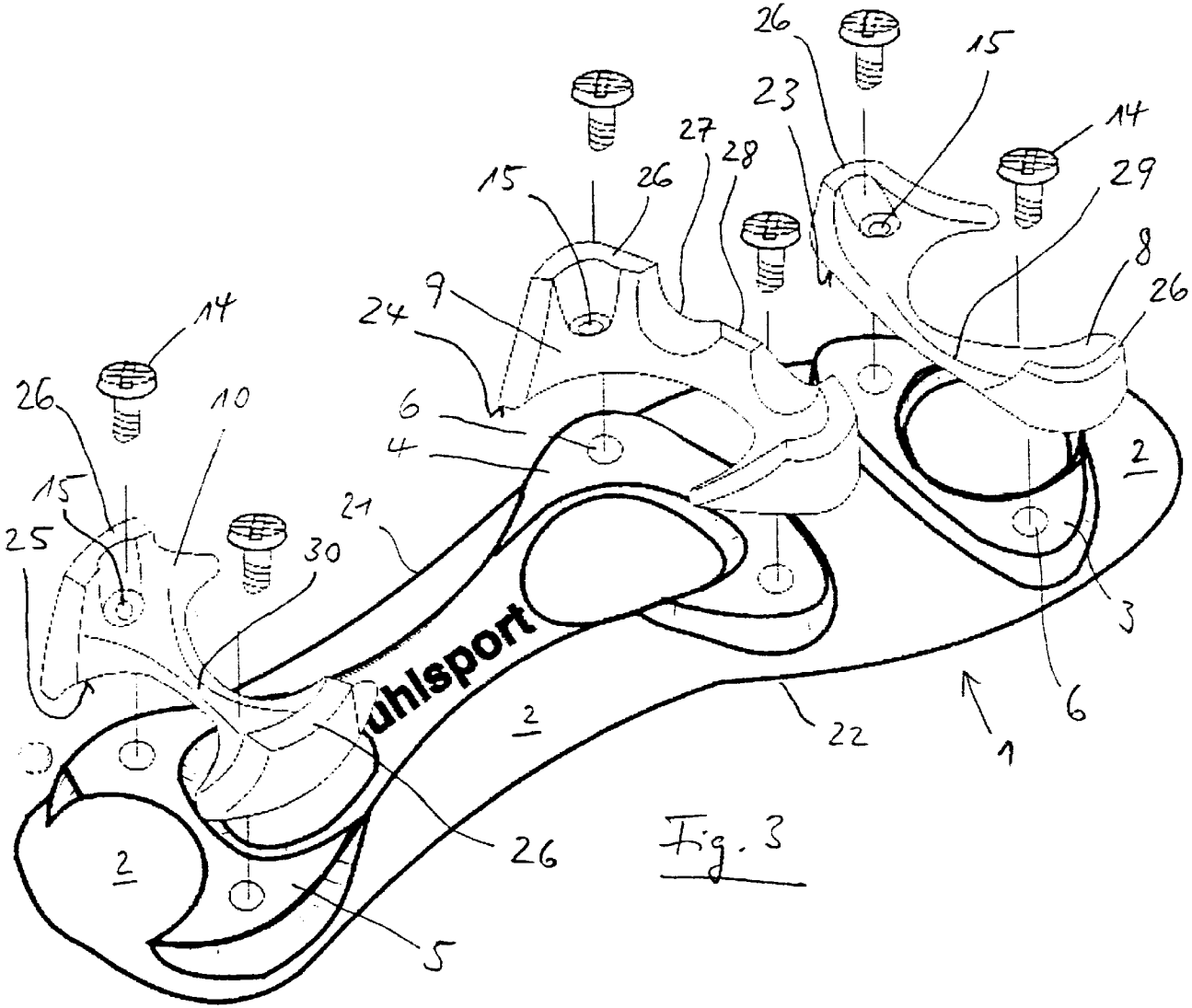
FIG. 3 is a perspective view of the underside of the sole of FIG. 1 and FIG. 2, equipped with three clamping jaws.

In the embodiment of the sports shoe according to the invention illustrated in FIG. 3, the sole 1 is equipped with three clamping jaws 8, 9, 10, which can be fastened to the sole 1 in an exchangeable manner by means of two screws 14 each, that can be screwed through the through-holes 15 into the threaded inserts 6.

The clamping jaws that are used as traction elements here each have a mounting surface 23, 24, 25 adapted to the geometric shape of the carrier surfaces 3, 4, 5 associated to them, the mounting surfaces covering completely the carrier surfaces 3, 4, 5, respectively.

An important feature of the invention is that the through-holes 15 in the clamping jaws 8, 9, 10 are registered with the threaded inserts 6, whereby the number and position of the geometric spots of the through-holes 15 and threaded inserts 6 are coincident and are each aligned with each other and whereby it is achieved that the sports shoe according to the invention can be provided with interchangeable sets of different traction elements, namely e.g. screw-in studs 7 (FIG. 2) and clamping jaws 8, 9, 10 (FIG. 3) capable of being screwed into the threaded inserts 6 of the same sole 1; one of these different sets of traction elements fully covers each of the carrier surfaces 3, 4, 5, whilst the other set which may consist of screw-in studs 7 or cams or spikes, only partially covers the carrier surfaces 3, 4, 5.

Starting from their respective mounting surfaces 23, 24, 25, the clamping jaws 8, 9, 10 taper with an increasing distance from the surface 2 of the sole 1. In the region of their maximum distance from the surface 2, the clamping jaws 8, 9, 10 form narrow webs 26, i.e. at places close to the distal and proximal longitudinal edges 21, 22 of the sole 1. In the region of the center of the sole, there are either channels 27 in the clamping jaw 9, between which a short web 28 remains which is not situated at the maximum distance from the sole's surface 2 just like the webs 26 located in the edge portion of the sole, but only achieves a smaller height between the mentioned maximum height and the surface 2 of the sole 1. In the region of the center of the sole, the clamping jaws 8, 10 may be made concave to such an extent that only narrow connecting webs 29, 30 remain between the edge portions raised as far as to the webs 26, these connecting webs 29, 30 achieving only a fraction of the maximum height at which the ground contact areas of the webs 26 are situated.

The sole 1 according to FIG. 2 equipped with screw-in studs is preferably used on hard fields, whilst the sole 1 according to FIG. 3 equipped with clamping jaws 8, 9, 10 offers to the player optimum grip on grass fields. If required, the screw-in studs 7 can be replaced by the clamping jaws 8, 9, 10 in very short time, and vice versa, without the sportsman having to change the shoes themselves. Due to the invention, he is able to adapt his shoes to the respective field conditions with ease.

The invention is not limited to the embodiments illustrated; it being rather possible to employ traction elements of any materials and formed in any way, as long as the respective mounting surfaces are adapted to the geometric shape of the corresponding carrier surfaces and as long as the fastening screws and through-holes, respectively, are in register with the threaded inserts.

What is claimed is:

1. A sports shoe, comprising a sole (1) which is made of plastic and has on its underside (2) at least one carrier surface (3 to 5) which is configured raised, in each of which surfaces (3 to 5) at least two threaded inserts (6) being embedded that serve for receiving traction elements (7 to 10) capable of being screwed in, wherein the at least one carrier surface (3 to 5) has such a geometric shape and the threaded inserts (6) in the at least one carrier surface (3 to 5) are positioned such that several interchangeable sets of different types of traction elements (7 to 10) are able to be screwed into the threaded inserts (6), with a first set of traction elements (8 to 10) fully covering the at least one carrier surface (3 to 5) whilst a second set of traction elements (7) only partially covering the at least one carrier surface (3 to 5).

2. The sports shoe of claim 1, wherein said second set of traction elements consist of a set of screw-in studs (7), cams or spikes, of which each screw-in stud, cam or spike comprises a threaded bolt (11) capable of being screwed into the threaded inserts (6).

3. The sports shoe of claim 2, wherein the screw-in studs (7) comprise a collar (13) in the shape of a truncated cone, the larger base circular area (12) of which is adapted to the extent of the at least one carrier surface (3 to 5).

4. The sports shoe of claim 1, wherein said first set of traction elements consist of a set of clamping jaws (8 to 10) which extend across the entire width of the sole (1) and comprise a mounting surface (23 to 25) adapted to the geometric shape of the at least one carrier surface (3 to 5) as well as through-holes (15) for receiving fastening screws (14), the through-holes being registered with the threaded inserts (6).

5. The sports shoe of claim 4, wherein starting from their mounting surface (23 to 25), the clamping jaws (8 to 10) taper with increasing distance from the surface of the sole (1).

6. The sports shoe of claim 5, wherein the clamping jaws (8 to 10) form narrow webs (26) in the region of their maximum distance from the surface of the sole (1).

7. The sports shoe of claim 6, wherein the webs (26) are only formed at places close to the lateral (21) and medial (22) longitudinal edges (21, 22) of the sole (1).

8. The sports shoe of claim 4, wherein the at least one carrier surface (3 to 5) and the mounting surfaces (23 to 25) of the clamping jaws (8 to 10) are configured so as to be H-, U-, V- or horseshoe-shaped.

* * * * *